US010760034B2

(12) United States Patent
Camire et al.

(10) Patent No.: US 10,760,034 B2
(45) **Date of Patent: *Sep. 1, 2020**

(54) STABLE UNIT DOSE COMPOSITIONS WITH HIGH WATER CONTENT

(71) Applicant: Henkel IP & Holding GmbH, Duesseldorf (DE)

(72) Inventors: Casey Elphege Camire, Shelton, CT (US); Patrick Shane Akeem Harewood, Hamden, CT (US); Cynthia L. Moser, Wilton, CT (US); Daniel Thomas Piorkowski, Fairfield, CT (US); David S. Stott, II, Madison, CT (US)

(73) Assignee: Henkel IP & Holding GmbH (DE)

( * ) Notice: Subject to any disclaimer, the term of this patent is extended or adjusted under 35 U.S.C. 154(b) by 5 days.

This patent is subject to a terminal disclaimer.

(21) Appl. No.: 15/879,933

(22) Filed: Jan. 25, 2018

(65) Prior Publication Data

US 2018/0216033 A1 Aug. 2, 2018

Related U.S. Application Data

(60) Provisional application No. 62/451,449, filed on Jan. 27, 2017.

(51) Int. Cl.

| | |
|---|---|
| ***C11D 17/04*** | (2006.01) |
| ***C11D 1/83*** | (2006.01) |
| ***C11D 1/831*** | (2006.01) |
| ***C11D 3/20*** | (2006.01) |
| ***C11D 3/22*** | (2006.01) |
| ***C11D 3/04*** | (2006.01) |
| ***C11D 3/43*** | (2006.01) |
| ***C11D 17/00*** | (2006.01) |
| *C11D 1/72* | (2006.01) |
| *C11D 1/22* | (2006.01) |
| *C11D 1/29* | (2006.01) |
| *C11D 1/14* | (2006.01) |

(52) U.S. Cl.

CPC ..... *C11D 1/831* (2013.01); *C11D 1/83* (2013.01); *C11D 3/046* (2013.01); *C11D 3/2075* (2013.01); *C11D 3/2079* (2013.01); *C11D 3/2086* (2013.01); *C11D 3/221* (2013.01); *C11D 3/43* (2013.01); *C11D 17/0026* (2013.01); *C11D 17/043* (2013.01); *C11D 17/045* (2013.01); *C11D 1/146* (2013.01); *C11D 1/22* (2013.01); *C11D 1/29* (2013.01); *C11D 1/72* (2013.01)

(58) Field of Classification Search

None

See application file for complete search history.

(56) References Cited

U.S. PATENT DOCUMENTS

| | | | |
|---|---|---|---|
| 3,218,776 | A | 11/1965 | Cloud |
| 3,308,067 | A | 3/1967 | Diehl |
| 3,453,779 | A | 7/1969 | Reifenberg |
| 4,663,071 | A | 5/1987 | Bush et al. |
| 4,776,455 | A | 10/1988 | Anderson et al. |
| 4,793,416 | A | 12/1988 | Mitchell |
| 5,616,781 | A | 4/1997 | Sajic et al. |
| 5,699,653 | A | 12/1997 | Hartman et al. |
| 5,722,217 | A | 3/1998 | Cloud |
| 5,958,864 | A | 9/1999 | Artiga Gonzalez et al. |
| 6,024,943 | A | 2/2000 | Ness et al. |
| 6,037,319 | A | 3/2000 | Dickler et al. |
| 6,056,949 | A | 5/2000 | Menzi et al. |
| 6,194,375 | B1 | 2/2001 | Ness et al. |
| 6,458,754 | B1 | 10/2002 | Velazquez et al. |
| 6,521,581 | B1 | 2/2003 | Hsu et al. |
| 6,727,215 | B2 | 4/2004 | Roberts et al. |
| 6,764,992 | B2 | 7/2004 | Kumar et al. |
| 6,878,679 | B2 | 4/2005 | Sommerville-Roberts et al. |
| 7,259,134 | B2 | 8/2007 | Beckholt et al. |
| 7,282,472 | B2 | 10/2007 | Kapur et al. |
| 7,304,025 | B2 | 12/2007 | Hardy et al. |
| 7,329,441 | B2 | 2/2008 | Catlin et al. |

(Continued)

FOREIGN PATENT DOCUMENTS

| | | | |
|---|---|---|---|
| DE | 10 2011 085 639 | A1 * | 5/2013 |
| EP | 193360 | A2 | 9/1986 |

(Continued)

OTHER PUBLICATIONS

International Search Report PCT/US2018/015172 Completed May 11, 2018; dated May 11, 2018 12 Pages.

(Continued)

*Primary Examiner* — Lorna M Douyon

(74) *Attorney, Agent, or Firm* — Bojuan Deng

(57) ABSTRACT

Stable unit dose compositions with high water content are provided. Such unit dose compositions include an aqueous composition having a water activity of from about 0.65 to about 0.95 and a water-soluble container formed from a water-soluble or water-dispersible film material. In one embodiment, the aqueous composition includes water in an amount of 25% to 70% by weight, a surfactant system, and a water binding agent. The surfactant system may include: (1) a linear alkylbenzene sulfonate (LAS) and/or an alcohol ethoxylsulfate (AES), (2) a non-ionic surfactant, and (3) a fatty acid. The unit dose compositions can prevent the enclosed liquid detergent composition with a high level of water content from dissolving or pre-maturely dispersing the water-soluble container.

18 Claims, 4 Drawing Sheets

(56) References Cited

U.S. PATENT DOCUMENTS

| | | | | |
|---|---|---|---|---|
| 7,439,215 | B2 | 10/2008 | Catlin et al. | |
| 7,464,519 | B2 | 12/2008 | Fisher et al. | |
| 7,563,757 | B2 | 7/2009 | Kouvroukoglou et al. | |
| 7,595,290 | B2 | 9/2009 | Pounds et al. | |
| 8,158,566 | B2 | 4/2012 | Wei | |
| 8,426,353 | B2 | 4/2013 | Ouali et al. | |
| 2005/0026806 | A1* | 2/2005 | Kaiser | B65B 9/04 510/439 |
| 2006/0160716 | A1* | 7/2006 | Fregonese | C11D 3/06 510/439 |
| 2006/0281658 | A1 | 12/2006 | Kellar et al. | |
| 2011/0224127 | A1 | 9/2011 | Blyth et al. | |
| 2013/0065811 | A1* | 3/2013 | Fernandez-Prieto | C11D 3/32 510/375 |
| 2013/0206638 | A1* | 8/2013 | Wong | C11D 3/046 206/524.7 |
| 2014/0243253 | A1 | 8/2014 | Schmiedel et al. | |
| 2014/0274859 | A1* | 9/2014 | Adamy | C11D 1/02 510/296 |
| 2015/0329807 | A1* | 11/2015 | Naqvi | C11D 3/2041 206/524.7 |
| 2015/0368594 | A1* | 12/2015 | Nagy | A61K 8/73 435/263 |
| 2016/0040099 | A1 | 2/2016 | Maes | |
| 2016/0201017 | A1 | 7/2016 | Mesa | |
| 2017/0158994 | A1* | 6/2017 | Letzelter | B65B 3/04 |

FOREIGN PATENT DOCUMENTS

| | | | |
|---|---|---|---|
| WO | 9532997 | A1 | 12/1995 |
| WO | 03052040 | A1 | 6/2003 |
| WO | 2010069957 | A1 | 6/2010 |
| WO | 2016162558 | A1 | 10/2016 |

OTHER PUBLICATIONS

International Search Report PCT/US2018/015169 Completed May 14, 2018; dated May 14, 2018 12 Pages.

* cited by examiner

Scale up 200 X Scale up 100 X

STABLE UNIT DOSE COMPOSITIONS WITH HIGH WATER CONTENT

FIELD OF INVENTION

This disclosure relates to stable unit dose compositions with high water content. Such unit dose compositions comprise an aqueous composition having a water activity of from about 0.65 to about 0.95 and a water-soluble container formed from a water-soluble or water-dispersible film material.

BACKGROUND OF THE INVENTION

Unit dose compositions can include a beneficial composition such as a detergent product, a color care agent, a softening agent, or a fragrance. Unit dose detergent products are often found by consumers to be preferable for use as they have several advantages, including convenience of use and dispensing, lower cost per use, and avoiding or minimizing direct skin contact with potentially irritating cleaning compositions.

Unit dose liquid detergent compositions are often contained within water-soluble or water-dispersible films, and thus are limited to low water levels to prevent the films from being dissolved or dispersed pre-maturely by the enclosed liquid detergent compositions. The typical water content of a unit dose liquid detergent composition is less than 25 wt % based on the total weight of the composition.

For example, U.S. Pat. No. 4,793,416 discloses unit dose liquid detergent compositions enclosed within a water-soluble polymeric film pouch, which exemplifies a liquid detergent composition with a water content of 16.29 wt %.

U.S. Pat. No. 6,037,319 discloses water-soluble packets containing concentrated liquid cleaning compositions, which contain less than about 10 wt % of water.

U.S. Pat. No. 7,563,757 discloses water soluble pouches containing liquid detergent compositions which contain less than 25 wt % water, and preferably between 5-15 wt % water.

US 2016/0040099 A1 discloses a unit dose liquid laundry detergent composition containing about 5.5-20 wt % (e.g., 11.66 wt %) of water.

Water is an inexpensive ingredient of unit dose compositions and a ubiquitous solvent. There is a need for an aqueous composition that contains high water content, which would reduce the cost of goods while retaining the benefit of the beneficial composition. The present disclosure provides such an aqueous composition, as well as a method of producing and using such a composition in unit dose compositions.

BRIEF SUMMARY OF THE INVENTION

The present invention is based on the discovery that the inclusion of a water binding agent in an aqueous composition of a unit dose pac helps to bind water, preventing pac films from being dissolved or dispersed pre-maturely by the enclosed liquid detergent compositions. As a result, the liquid composition in the unit dose pacs can have a water content much higher than that known in the conventional unit dose pacs. Despite the high water content and the high activity, the unit dose pacs of the present invention are stable. Stability of unit dose pacs are determined under stressed pac aging conditions through measurement of pac height, % weight loss, dissolution rate, etc. Even if the water content is about the same as those in the art, the unit dose pacs of the present invention are much more stable and more rigid, compared to those in the art, as a result of incorporating the water binding agent and the particular formulations developed by the inventors, which in turn may cause the modification of the surfactant structure in the liquid composition. Structured surfactant system may further prevent "free" movement of water, leading to stability of the unit dose pacs.

According to one aspect of the present invention, a unit dose composition is provided which comprises (a) a water-soluble container formed from a water-soluble or water-dispersible film material; (b) an aqueous composition comprising: (i) water present in an amount from about 20% to about 95% by weight; preferably, from about 25% to about 70%; more preferably, from about 25% to about 55% by weight; even more preferably, from about 30% to about 40% by weight; (ii) a beneficial composition which comprises a surfactant system present in an amount of about 0.1% to about 70% by weight; and (iii) a water binding agent present in an amount of about 0.5% to about 50% by weight, preferably about 0.5% to 20% by weight, more preferably about 1% to 10% by weight; wherein the aqueous composition has a water activity of from about 0.65 to about 0.95. In some embodiments, the beneficial composition consists essentially of or consists of a structured surfactant system.

Suitable water binding agent include, but are not limited to, a saccharide, an organic solvent, a salt, and a mixture thereof.

In some embodiments, the organic solvent may be selected from the group consisting of propylene glycol, butylene glycol, pentylene glycol, hexylene glycol, heptylene glycol, octylene glycol, 2-methyl-1,3-propanediol, diethylene glycol, triethylene glycol, glycerol, 1,3 propanediol, triacetin, ethyl acetate, benzyl alcohol, and a mixture thereof.

In some embodiments, the saccharide is selected from the group consisting of fructose, glucose, sucrose, xylitol, sorbitol, mannitol, erythritol, dulcitol, inositol, adonitol, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fructooligosaccharides, maltotetraol, maltotriol, malto-oligosaccharides, lactulose, melibiose, raffinose, rhamnose, ribose, high fructose corn/starch syrup, coupling sugars, soybean oligosaccharides, or glucose syrup, and a mixture thereof.

In other embodiments, the water binding agent is limited to a saccharide, an organic solvent, or a mixture thereof, but no salt. The salt that is excluded may be composed of a cation and an anion; wherein the cation is selected from the group consisting of sodium, calcium, potassium, magnesium, quaternary ammonium, pyridinium, tris(2-hydroxyethyl)methyl ammonium, and a mixture thereof, and the anion is selected from the group consisting of a halide, phosphate, sulphate, formate, acetate, citrate, maleate, succinate, methylsulfate, and a mixture thereof.

In some embodiments, the water binding agent does not include a salt.

According to another aspect of the present invention, a unit dose composition is provided which comprises (a) a water-soluble container formed from a water-soluble or water-dispersible film material; (b) an aqueous composition comprising: (i) water present in an amount from about 20% to about 70% by weight; preferably, from about 30% to about 60% by weight, more preferably, from about 30% to about 55% by weight; (ii) a beneficial composition which comprises a structured surfactant system present in an amount of about 15% to about 70% by weight, preferably, from about 25% to about 55% by weight, more preferably, from about 35% to about 45% by weight; and (iii) a salt present in an amount of about 0.1% to about 50% by weight, preferably, about 0.5% to about 25% by weight, more preferably, from about 2% to about 10% by weight; wherein the aqueous composition has a water activity of from about 0.65 to about 0.95, preferably, from about 0.80 to about 0.90. In some embodiments, the beneficial composition consists essentially of or consists of a structured surfactant system.

The salt contains a cation and an anion, wherein the cation may be selected from the group consisting of sodium, calcium, potassium, magnesium, quaternary ammonium, pyridinium, tris(2-hydroxyethyl)methyl ammonium, and a mixture thereof, and the anion may be selected from the group consisting of a halide, phosphate, sulphate, formate, acetate, citrate, maleate, succinate, methylsulfate, and a mixture thereof. In some embodiments, the salt is sodium chloride, sodium citrate, or sodium formate. In one embodiment, the salt is sodium citrate. Sodium citrate may be trisodium citrate.

It has been unexpectedly discovered that the addition of the salt may facilitate the formation of a structured surfactant system. From this aspect, water unexpectedly functions more than just a water binding agent. One of the structured surfactant system is a gel form. A high content active (e.g., surfactant) formulation, for example, surfactants in an amount of about or more than 40% wt, requires less amount of the salt to effectuate a gel formation. In contrast, a low content active (e.g., surfactant) formulation, for example, surfactants in an amount of about or less than 35% wt, requires a larger amount of the salt to effectuate a gel formation, but such gel formation is more viscous-more solid like. It has further been discovered that the structured surfactant system is of lamellar structure on molecular scale. The patterns of the lamellar structures of the surfactant systems different, depending on the surfactant and salt formulations. The physical properties of unit dose pacs prepared from the formulations are different. It was unexpected that lamellar structured surfactant composition can be compatible with water-soluble films and can survive the unit dose pacs preparation process and thus create stable unit dose pacs.

It is also unexpectedly discovered that the surfactant amount and the salt amount required to form a lamellar structure in the liquid composition are inversely related. More surfactant in the liquid composition would require less salt to form a lamellar structure. The types of lamellar structure may vary depending on the concentration of surfactant in the liquid composition. Without wishing to be bound by theory, it is believed that the lamellar-structured surfactant system provides patterns of structures that prevent "free" movement of water, and thus preventing water with high water activity from pre-maturely dissolving water soluble films of the container.

In some embodiments, the structured surfactant system is present in an amount of about 40% to about 70% by weight; and the salt is present in an amount of about 0.5% to about 5% by weight.

In other embodiments, the structured surfactant system is present in an amount of about 15% to about 35% by weight; and the salt is present in an amount of about 5% to about 20% by weight, preferably from about 5% to about 15% by weight, and more preferably, from about 5% to about 10% by weight.

In some embodiments, the aqueous composition may further comprise a water binding agent selected from a saccharide, an organic solvent, or a combination thereof. Suitable saccharides and suitable organic solvents for use as a water binding agent are those described previously in this disclosure. In some embodiments, the liquid composition contains neither saccharide nor organic solvent.

In some embodiments, the aqueous composition is substantially free of a hygroscopic chelant, a hygroscopic glycol, or an organic solvent.

In some embodiments, the aqueous composition is substantially free of a polymer that stabilizes the water-soluble container.

In some embodiments, the unit dose composition is substantially free of efflorescence.

In some embodiments, the aqueous composition comprises from about 30% to about 60%, preferably from about 30% to about 55%, and more preferably from about 35% to about 50% by weight of water. In other embodiments, the aqueous composition comprises from about 30% to about 85%, preferably from about 40% to about 80%, more preferably from about 50% to about 70%, and more preferably from about 55% to about 65% by weight of water. In some embodiments, the aqueous composition has a water activity of from 0.75 to about 0.95, preferably from about 0.8 to about 0.95, more preferably from about 0.80 to about 0.90.

In one embodiment, the surfactant system comprises an anionic surfactant, and a non-ionic surfactant.

In some embodiments, the surfactant system further comprises a defoamer. In some embodiments, the surfactant system further comprises a zwitterionic surfactant or an amphoteric surfactant.

In some embodiments, the surfactant system is present in an amount of about 0.1% to 70%, preferably about 30% to 60%, more preferably about 40% to 50% by weight.

In some embodiments, wherein the anionic surfactant and the non-ionic surfactant are present in a weight ratio of about 1:9 to 9:1, preferably about 3:7 to 7:3, more preferably about 4:6 to 6:4.

In some embodiments, the surfactant system comprising (1) a linear alkylbenzene sulfonate (LAS) and/or an alcohol ethoxylsulfate (AES), (2) an alcohol ethoxylate (AE), and (3) a fatty acid.

In some embodiments, the LAS is present in an amount of about 10% to about 20% by weight of the surfactant system.

In some embodiments, the AES is present in an amount of about 20% to about 40% by weight of the surfactant system.

In some embodiments, the AE is present in an amount of about 30% to about 70%, preferably from about 20% to about 50%, by weight of the surfactant system.

In some embodiments, the fatty acid is present in an amount of about 1% to about 15% by weight of the surfactant system.

In some embodiments, the LAS and the AES are present in a weight ratio of from about 1:1 to about 1:5 (e.g., about 1:2.5).

In some embodiments, the LAS and the AE are present in a weight ratio of from about 1:1 to about 1:10 (e.g., about 1:4).

In some embodiments, the LAS and the fatty acid are present in a weight ratio of from about 6:1 to about 1:1 (e.g., about 3:1).

In some embodiments, the weight ratio of LAS:AES:AE is about 0.9-1.1:1.8-2.2:2.7-3.3 (e.g., about 1:2:3).

In some embodiments, the surfactant system is a structured surfactant system or a surfactant-structured system. In some embodiments, the structured surfactant system includes lamellar structure. The lamellar structure may be present in a "Maltese Crosses" pattern or in a "Mosaic" pattern.

In one embodiment, the present disclosure provides a unit dose composition comprising (a) a water-soluble container formed from a water-soluble or water-dispersible film material; (b) an aqueous composition comprising: (i) from about 20% by weight to about 95% by weight of water; and (ii) a surfactant system comprising (1) a linear alkylbenzene sulfonate (LAS) and/or an alcohol ethoxylsulfate (AES), (2) an alcohol ethoxylate (AE), and (3) a fatty acid, wherein the aqueous composition has a water activity of from about 0.65 to about 0.95.

In some embodiments, the aqueous composition is substantially free of a sulphate surfactant.

In some embodiments, wherein the beneficial composition comprises a fragrance composition comprising a neat oil, an encapsulated fragrance, an oil-in-water emulsion, or a combination thereof. In some embodiments, the fragrance composition is present in an amount from about 0.1% to about 50% by weight, preferably about 0.1% to about 15% by weight.

However, in some embodiments, the beneficial composition does not contain any neat oil. In other embodiments, the beneficial composition does not contain any fragrance oil.

In some embodiments, the beneficial composition comprises a color care agent or a softening agent.

In some embodiments, the aqueous composition further comprises a surfactant stabilizer. Examples of the surfactant stabilizer include, but are not limited to, polysorbate, quillaja extract, octenyl succinic anhydride (OSA) modified starch, gum acacia, modified gum acacia, and a mixture thereof.

In some embodiments of the present disclosure, the aqueous composition is substantially free of a polymer that stabilizes the film. In some embodiments, the aqueous composition is substantially free of a polymer made from vinyl dicarboxylic acid monomers. In some embodiments of the present disclosure, the aqueous composition is substantially free of a polymer that stabilizes the film. In some embodiments, the aqueous composition is substantially free of a polymer made from vinyl dicarboxylic acid monomers.

In some embodiments, the water-soluble or water-dispersible film material is selected from the group consisting of polyvinyl alcohol (PVOH), polyvinyl acetate (PVA), film forming cellulosic polymer, polyacrylic acid, polyacrylamide, polyanhydride, polysaccharide, and a mixture thereof.

In some embodiments, the water-soluble or water-dispersible film material is polyvinyl alcohol (PVOH) or polyvinyl acetate (PVA).

In some embodiments, the water-soluble or water-dispersible film material is between about 50 to about 120 microns thick, preferably about 60 to about 100 microns.

DETAILED DESCRIPTION OF THE INVENTION

Figure 1:
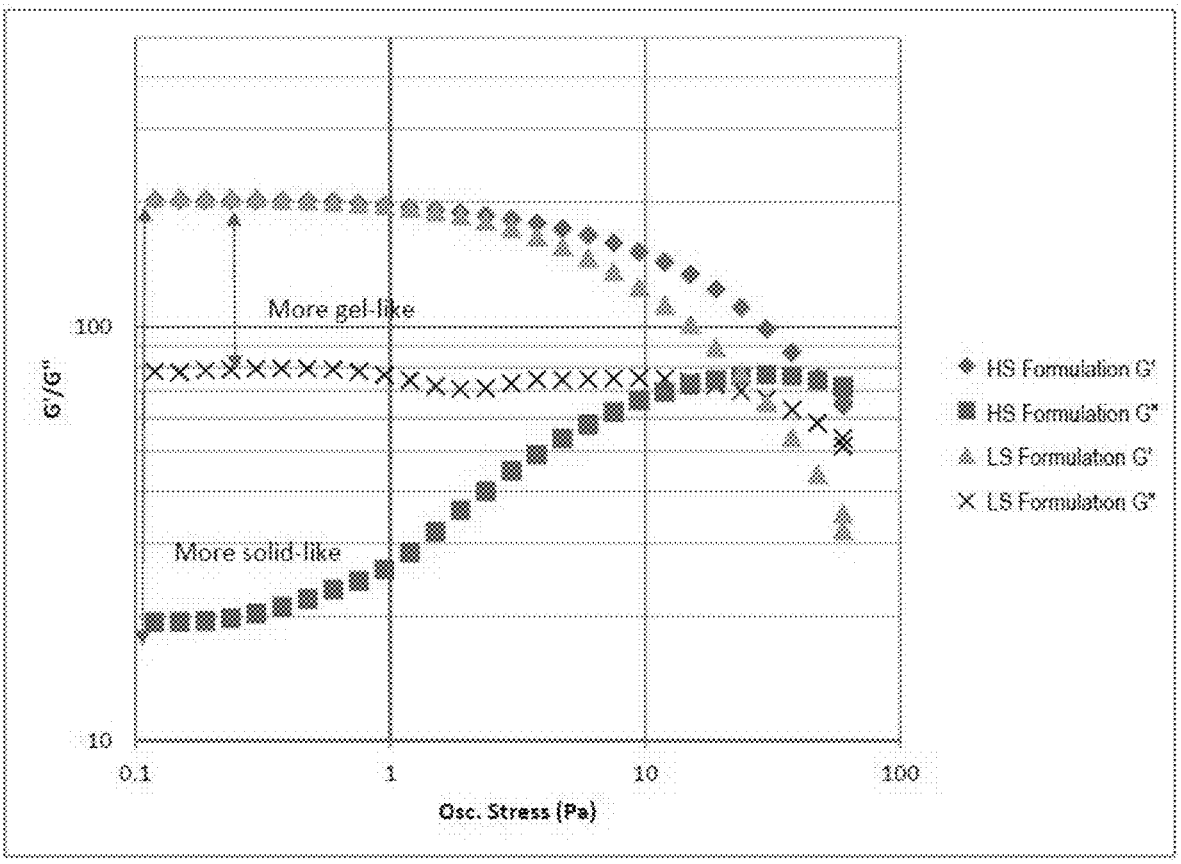
FIG. 1 depicts the rheology of the low active/high salt formulation and the high active/low salt formulation.

The following description provides specific details, such as materials and dimensions, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the detergent industry. Moreover, the processes below describe only steps, rather than a complete process flow, for manufacturing the aqueous surfactant system and unit dose composition containing the aqueous surfactant system according to the present invention.

As used herein, "a," "an," or "the" means one or more unless otherwise specified.

The term "or" can be conjunctive or disjunctive.

Open terms such as "include," "including," "contain," "containing" and the like mean "comprising."

The term "about" as used herein, includes the recited number+10%. For example, "about 10" means 9 to 11.

The term "solvent" used herein does not include water. It also does not include neutralization agents, such as triethanolamine, monoethanolamine, sodium hydroxide, and acids, or agents that are conventionally used as surfactants.

The phrase "substantially free of" means that a composition contains little no specified ingredient/component, such as less than about 5 wt %, 4 wt %, 3 wt %, 2 wt %, 1 wt %, 0.5 wt %, or 0.1 wt %, or below the detectable level of the specified ingredient. For example, the phrase "substantially free of a hygroscopic chelant, a hygroscopic glycol, or an organic solvent" refers to an aqueous composition of the present disclosure that contains little or no hygroscopic chelant, hygroscopic glycol, or organic solvent. An aqueous composition of the present disclosure that is substantially free of a hygroscopic chelant, a hygroscopic glycol, or an organic solvent may contain, for example, less than about 5 wt %, 4 wt %, 3 wt %, 2 wt %, 1 wt %, 0.5 wt %, or 0.1 wt % of a hygroscopic chelant, a hygroscopic glycol, or an organic solvent, based on the total weight of the composition.

The "%" described in the present disclosure refers to the weight percentage unless otherwise indicated.

Aqueous Composition

In one aspect, the present disclosure provides an aqueous composition, comprising (i) from about 20% by weight to about 70% by weight of water; and (ii) a beneficial composition, wherein the aqueous composition has a water activity of from about 0.65 to about 0.95. In some embodiments, the beneficial composition comprises a surfactant system comprising (1) an anionic surfactant, and (2) a non-ionic surfactant.

The surfactant system can be a structured surfactant system, which is a surfactant system that has a certain set of rheological properties and exhibits viscoelastic behaviors (especially yield stress, a linear viscoelastic region) in certain strain/stress ranges. This can be achieved by including polymers, surfactants, clays, and most commonly, combinations thereof.

The surfactant system can also be a surfactant-structured system, which is a structured system that achieves its viscoelastic behaviors by including surfactants alone. A common example is a lamellar surfactant system.

While not wishing to be bound by the theory, it is believed that the structured surfactant system prevents water from migrating out of the system to weaken or dissolve a water-soluble film that encloses the system. As such, the structured surfactant system increases the overall stability of a unit dose composition. The structured surfactant system is not a solid, and does not rapidly separate, or solidify when it is diluted with water. These properties lead to its versatile applications.

In some embodiments, the surfactant system further comprises a defoamer. A defoamer is a chemical additive that prevents the formation of foam and/or breaks foam already formed. Examples of commonly used defoamers include fatty acids, polydimethylsiloxanes, silicones, twin chain alcohols and some alcohols, glycols, stearates, and insoluble oils.

In some embodiments, the surfactant system further comprises a zwitterionic surfactant or an amphoteric surfactant. A zwitterionic surfactant is a net-neutrally charged molecule that has positive and negative charges. Some simple amphoteric molecules can only form a net positive or negative charge depending on the pH. Other amphoteric molecules can form a net-neutral charge, depending on the pH. Examples of zwitterionic materials include betaine.

In some embodiments, the anionic surfactant can be linear alkylbenzene sulfonic acid or a salt thereof, alkyl ethoxylated sulphate, alkyl propoxy sulphate, alkyl sulphate, or a mixture thereof.

In some embodiments, the nonionic surfactant can be alcohol ethoxylate, alcohol propoxylate, or a mixture thereof.

In some embodiments, the aqueous composition can be substantially free of a sulfate surfactant.

In some embodiments, the surfactant system is present in an amount of about 0.1% to 70%, 1% to 70%, 5% to 70%, 10% to 70%, 15% to 70%, 20% to 70%, 30% to 70%, 40% to 70%, 50% to 70%, or 60% to 70% by weight of the aqueous composition. In some embodiments, the surfactant system is present in an amount of about 0.1% to 60%, 1% to 60%, 5% to 60%, 10% to 60%, 20% to 60%, 30% to 60%, 40% to 60%, or 50% to 60% by weight. In some embodiments, the surfactant system is present in an amount of about 0.1% to 50%, 1% to 50%, 5% to 50%, 10% to 50%, 20% to 50%, 30% to 50%, or 40% to 50% by weight. In some embodiments, the surfactant system is present in an amount of about 15% to about 35%, about 35% to about 45%, about 25% to about 55%, about 30% to 60%, by weight. In some embodiments, the surfactant system is present in an amount of about 40% to 50% by weight.

In some embodiments, the anionic surfactant and the non-ionic surfactant are present in a weight ratio of from 1:9 to 9:1, preferably from 3:7 to 7:3, more preferable from 4:6 to 6:4. In some embodiments, the anionic surfactant and the non-ionic surfactant are present in a weight ratio of from 1:9 to 9:1, from 1:8 to 8:1, from 1:7 to 7:1, from 1:6 to 6:1, from 1:5 to 5:1, from 1:4 to 4:1, from 1:3 to 3:1, or from 1:2 to 2:1. In some embodiments, the anionic surfactant and the non-ionic surfactant are present in a weight ratio of from 2:3 to 3:2, from 2:5 to 5:2, from 3:4 to 4:3, from 3:5 to 5:3, or from 3:7 to 7:3. In some embodiments, the anionic surfactant and the non-ionic surfactant are present in a weight ratio of about 1:1.

In one embodiment, the present disclosure provides a unit dose composition comprising (a) a water-soluble container formed from a water-soluble or water-dispersible film material; (b) an aqueous composition comprising: (i) from about 20% by weight to about 95% by weight of water; and (ii) a surfactant system comprising (1) a linear alkylbenzene sulfonate (LAS) and/or an alcohol ethoxylsulfate (AES), (2) an alcohol ethoxylate (AE), and (3) a fatty acid, wherein the aqueous composition has a water activity of from about 0.65 to about 0.95.

In some embodiments, the aqueous composition comprises from about 20% to about 60%, preferably from about 25% to about 55%, more preferably from about 35% to about 50% by weight of water. In some embodiments, the aqueous composition comprises from about 20% to about 90%, from about 20% to about 80%, from about 20% to about 70%, from about 20% to about 60%, from about 30% to about 90%, from about 30% to about 80%, from about 30% to about 70%, from about 30% to about 60%, from about 30% to about 55%, from about 40% to about 90%, from about 40% to about 80%, from about 40% to about 70%, from about 40% to about 60%, from about 40% to about 50%, from about 50% to about 90%, from about 50% to about 80%, from about 50% to about 70%, from about 50% to about 60%, from about 60% to about 90%, from about 60% to about 80%, from about 60% to about 70%, from about 70% to about 90%, from about 70% to about 80%, from about 80% to about 90% by weight of water.

In some embodiments, the aqueous composition has a water activity of from 0.75 to about 0.95, preferably from about 0.8 to about 0.95, more preferably from about 0.80 to about 0.90.

In some embodiments, the aqueous composition of the present disclosure does not contain or is substantially free of a hygroscopic chelant, such as iron and/or manganese chelants, diethylenetriamine pentaacetate, diethylene triamine penta(methyl phosphonic acid), ethylenediamine-N,N'-disuccinic acid, ethylenediamine tetraacetate, ethylenediamine tetra(methylene phosphonic acid), hydroxyethane di(methylene phosphonic acid), 1-hydroxyethanediphosphonic acid and salts thereof, N,N-dicarboxymethyl-2-aminopentane-1,5-dioic acid and salts thereof, and 2-phosphonobutane-1,2,4-tricarboxylic acid and salts thereof.

In some embodiments, the aqueous surfactant system of the present disclosure does not contain or is substantially free of a hygroscopic glycol or an organic solvent, such as alcohol, ethylene glycol, propylene glycol, diethylene glycol, dipropylene glycol, polyethylene glycol (PEG) of molecular weight between 300 and 600, or monoethanolamine.

Water

The unit dose compositions of the present disclosure contain a high content of water. The aqueous composition may comprise greater than 10 wt %, greater than 20 wt %, greater than 30 wt %, greater than 40 wt %, greater than 50 wt %, or greater than 60 wt %, greater than 70 wt %, or greater than 80 wt % of water, based on the total weight of the aqueous composition. The aqueous composition may comprise less than 95 wt %, less than 90 wt %, less than 80 wt %, less than 70 wt %, less than 60 wt %, less than 50 wt %, less than 45 wt %, less than 40 wt %, or less than 30 wt % by weight of water, based on the total weight of the aqueous composition. In some embodiments, the aqueous composition contains about 20 to about 95 wt %, about 20 to about 60 wt %, about 20 to about 40 wt %, about 20 to about 30 wt %, about 30 to about 90 wt %, about 30 to about 70 wt %, about 30 to about 60 wt %, about 30 to about 50 wt %, about 30 to about 40 wt %, about 40 to about 60 wt %, about 45 to about 60 wt %, or about 40 to about 50 wt % of water, based on the total weight of the aqueous composition. In other embodiments, the aqueous composition comprises from about 30% to about 85%, preferably from about 40% to about 80%, more preferably from about 50% to about 70%, and more preferably from about 55% to about 65% by weight of water. In one embodiment, the aqueous composition contains about 40 to about 45 wt % or about 45 to about 50 wt % of water, based on the total weight of the aqueous composition.

The present disclosure provides aqueous compositions containing high water content and having a water activity of from 0.65 to 0.95. The water activity of an aqueous composition is defined as the partial pressure of water in the aqueous composition divided by the saturation pressure of water at the temperature of the aqueous composition. If no temperature is specified, the default temperature is room temperature. The water activity can be determined by placing a sample in a container which is then sealed, and after equilibrium is reached, determining the relative humidity above the sample. The water activity is calculated from the equilibrium relative humidity according to the following equation:

$$\text{Water activity}(Aw)=(\text{Equilibrium relative humidity})/100$$

In some embodiments, the water activity of the aqueous compositions of the present disclosure is from about 0.50 to about 0.95, from about 0.50 to about 0.90, from about 0.50 to about 0.85, from about 0.50 to about 0.80, from about 0.50 to about 0.70, from about 0.50 to about 0.60, from about 0.60 to about 0.95, from about 0.60 to about 0.90, from about 0.60 to about 0.85, from about 0.60 to about 0.80, from about 0.60 to about 0.70, from about 0.65 to about 0.90, from about 0.65 to about 0.85, from about 0.65 to about 0.80, from about 0.65 to about 0.70, from about 0.70 to about 0.95, from about 0.70 to about 0.90, from about 0.70 to about 0.85, from about 0.70 to about 0.80, from about 0.80 to about 0.95, from about 0.80 to about 0.90, or from about 0.80 to about 0.85. In some embodiments, the water activity of the aqueous compositions of the present disclosure is from about 0.82 to about 0.87. In some embodiments, the water activity of the aqueous compositions of the present disclosure is about 0.60, 0.65, 0.70, 0.75, 0.80, 0.85, 0.90, or 0.95.

Linear Alkylbenzene Sulfonate (LAS)

Linear alkylbenzenesulfonate (LAS) is a water soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids. Suitable LAS includes sodium and potassium linear, alkylbenzene sulfonates in which the average number of carbon atoms in the alkyl group is between 11 and 14. Sodium $C_{11}$-$C_{14}$ (e.g., $C_{12}$) LAS is one suitable anionic surfactant for use herein.

In some embodiments, the amount of LAS in the surfactant system is selected so as to form a structured surfactant system. In some embodiments, the surfactant system contains about 8 to about 25 wt %, about 10 to about 20 wt %, or about 12 to 15 wt % of linear alkylbenzenesulfonate, based on the total weight the surfactant system.

Alcohol Ethoxylsulfate (AES)

Alcohol ethoxysulfate (AES), also known as alkyl ether sulfates or alkyl polyethoxylate sulfates, are compounds having Formula (I):

$$R_1—O—(C_2H_4O)_n—SO_3M \quad (I),$$

wherein $R_1$ is a $C_8$-$C_{22}$ alkyl group, n is from 1 to 20, and M is a salt-forming cation. Preferably, $R_1$ is a $C_{10}$-$C_{18}$ alkyl, or a $C_{10}$-$C_{15}$ alkyl, n is from 1 to 15, 1 to 10, or 1 to 8, and M is sodium, potassium, ammonium, alkylammonium, or alkanolammonium. More preferably, $R_1$ is a $C_{12}$-$C_{16}$ alkyl, n is from 1 to 6, and M is sodium. In one embodiment, the alkyl ether sulfate is sodium lauryl ether sulphate (SLES). The AES will generally be used in the form of mixtures comprising varying $R_1$ chain lengths and varying degrees of ethoxylation. Frequently such mixtures will inevitably also contain some unethoxylated alkyl sulfate materials, i.e., n=0 in the above Formula (I). Unethoxylated alkyl sulfates may also be added separately to the aqueous surfactant system of present disclosure and used as or in any anionic surfactant component which may be present. Suitable unalkoyxylated, e.g., unethoxylated, alkyl ether sulfate surfactants are those made by the sulfation of higher $C_8$-$C_{20}$ fatty alcohols. Conventional alkyl sulfate surfactants may also be suitable herein, which have the general formula of: $R_1OSO_3M^+$, wherein $R_1$ and M each has the same definition as described above.

Exemplary AES includes those sold under the tradename CALFOAM® 303 (Pilot Chemical Company, California).

In some embodiments, the amount of AES the aqueous surfactant system of the present disclosure is selected so as to form a structured surfactant system. In some embodiments, the surfactant system contains from about 15 to about 45 wt %, about 20 to about 40 wt %, or about 25 to 35 wt % of AES, based on the total weight the surfactant system.

In some embodiments, the weight ratio of LAS to AES in the surfactant system is from about 1:1 to about 1:5, from about 1:1 to about 1:3, or from about 1:2 to about 1:3. In some embodiments, the weight ratio of LAS to AES is about 1:2.5.

Non-Ionic Surfactant

The surfactant system of the present disclosure contains a non-ionic surfactant. A wide range of non-ionic surfactants can be used herein. For example, the non-ionic surfactants include, but are not limited to alkoxylated alcohols, polyoxyalkylene alkyl ethers (e.g., those marketed under the trade name Pluronic® (e.g., Pluronic® PE or Pluronic® RPE, available from BASF), polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof. Preferably, the non-ionic surfactant is an alcohol ethoxylate (AE).

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (II):

$$R_2—(—O—C_2H_4—)_m—OH \quad (II)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

One suitable AE is Tomadol® 25-7 (available from Air Product). Other suitable AEs include Genapol® C200 (available from Clariant), which is a coco alcohol having an average degree of ethoxylation of 20.

In some embodiments, the amount of non-ionic surfactant in the surfactant system is selected so as to form a structured surfactant system. In some embodiments, the aqueous surfactant system comprises about 30 to about 70 wt % of a non-ionic surfactant, based on the total weight the surfactant system.

In some embodiments, the surfactant system of the present disclosure comprises from about 30 to about 70 wt %, from about 40 to about 60 wt %, about 45 to about 60 wt %, from about 50 to about 60 wt %, about 45 to about 55 wt %, or about 45 to about 50 wt % of AE, based on the total weight the surfactant system.

In some embodiments, the weight ratio of LAS to non-ionic surfactant (e.g. AE) in the surfactant system is from about 1:1 to about 1:10. In some embodiments, the weight ratio of LAS to AE in the surfactant system is from about 1:1 to about 1:10, from about 1:1 to 1:8, or from about 1:1 to 1:6. In one embodiment, the weight ratio of LAS to AE is about 1:4.

Fatty Acid

The surfactant system of the present disclosure contains a fatty acid. Suitable fatty acid may be any fatty acid having formula: $R_3$—C(O)OH, wherein $R_3$ is a $C_5$-$C_{21}$ linear or branched aliphatic group. Preferably, the $R_3$ is a $C_{13}$-$C_{21}$ linear or branched aliphatic group.

In some embodiments, the fatty acid is hexanoic acid, heptanoic acid, octanoic acid, nonanoic acid, capric acid, undecanoic acid, dodecanoic acid (lauric acid), tridecanoic acid, myristic acid, pentadecanoic acid, palmitic acid, heptadecanoic acid, stearic acid, nonadecanoic acid, eicosanoic acid, heneicosanoic acid, docosanoic acid, myristoleic acid, palmitoleic acid, sapienic acid, oleic acid, elaidic acid, vaccenic acid, linoleic acid, linoelaidic acid, arachidonic acid, eicosapentaenoic acid, erucic acid, docosahexaenoic acid, or a mixture thereof.

In some embodiments, the fatty acid is dodecanoic acid (also known as coconut fatty acid).

In some embodiments, the amount of the fatty acid in the surfactant system is selected so as to form a structured surfactant system. In some embodiments, the surfactant system of the present disclosure contains from about 1 to about 15 wt %, from about 1 to about 10 wt %, from about 1 to about 7 wt %, from about 1 to about 6 wt %, from about 1 to 5 wt %, or from 1 about to 4 wt % of fatty acid, based on the total weight the surfactant system. In some embodiments, the surfactant system of the present disclosure contains from about 4 wt % of fatty acid based on the total weight the surfactant system.

In some embodiments, the weight ratio of LAS to fatty acid in the aqueous surfactant system is from about 6:1 to about 1:1, from about 5:1 to about 1:1, from about 4:1 to about 1:1, or from about 3:1 to about 1:1. In one embodiment, the weight ratio of LAS to fatty acid is about 3:1.

In some embodiments, the weight ratio of LAS:AES:AE in the surfactant system is about 0.9-1.1:1.8-2.2:2.7-3.3. In one embodiment, the weight ratio of LAS:AES:AE is about 1:2:3.

In one embodiment, the surfactant system of the present disclosure contains about 10 to 15 wt % LAS, about 30 to 35 wt % AES, about 50 to 55 wt % of AE, and about 3 to 5 wt % fatty acid based on the total weight the surfactant system.

In one embodiment, the surfactant system of the present disclosure contains about 13 wt % LAS, about 31 wt % AES, about 52 wt % of AE, and about 4 wt % fatty acid based on the total weight the surfactant system.

Buffer

The aqueous composition of the present disclosure may further contain a buffer. A wide range of buffers can be used herein. For example, the buffer may comprise a citrate or a formate, and optionally an amine (e.g., triethanolamine). In some embodiments, the aqueous composition contains from about 1 to about 15 wt %, preferably from about 5 to about 10 wt % of the buffer, based on the total weight of the aqueous composition.

Water Binding Agent

A water binding agent can used in an aqueous composition to reduce its water activity. Examples of the water binding agent include, but are not limited to, a salt, a saccharide, an organic solvent, and a mixture thereof. In some embodiments, the water binding agent is a salt and the composition contains no saccharide or organic solvent. In other embodiments, the water binding agent is saccharide or an organic solvent only.

A salt comprises a cation and an anion, and can be an inorganic salt or an organic salt. The cation can be inorganic or organic, such as sodium, calcium, potassium, magnesium, quaternary ammonium, pyridinium, tris(2-hydroxyethyl) methyl ammonium, or a mixture thereof. The anion can be inorganic or organic, such as a halide, phosphate, sulphate, formate, acetate, citrate, maleate, succinate, methylsulfate, and a mixture thereof.

In some embodiments, the salt can be an ionic liquid, which includes but is not limited to, tris(2-hydroxyethyl) methyl ammonium methylsulfate, trioctyl methyl amine dioctyl sulfosuccinate, triisooctyl methyl amine C12-C13 methyl branched dodecyl sulfate, tetraoctyl amine dodecyl sulfate, N-dodecyl-N,N-dimethyl-N-hydroxyammonium dodecyleethoxysulfate, N-(dodecylamindopropyl)-N, N-dimethyl-N-carboxymethylammonium, and N-decyl-N,N-dimethyl-N-hydroxyammonium 2,4,8-trimethylnonyl-6-(triethoxysulfate).

In some embodiments, the salt is sodium chloride, sodium citrate, or sodium formate. In one embodiment, the salt is sodium citrate. Sodium citrate can be trisodium citrate.

In some embodiments, the aqueous composition of the present disclosure is substantially free of a salt.

In some embodiments, the water binding agent is an organic solvent. Examples of the organic solvent include, but are not limited to, propylene glycol, butylene glycol, pentylene glycol, hexylene glycol, heptylene glycol, octylene glycol, 2-methyl-1,3-propanediol, diethylene glycol, triethylene glycol, glycerol, 1,3-propanediol, triacetin, ethyl acetate, benzyl alcohol, and a mixture thereof.

In some embodiments, the aqueous composition of the present disclosure is substantially free of an organic solvent.

In some embodiments, the water binding agent is a saccharide. Examples of the saccharide include, but are not limited to, fructose, glucose, sucrose, xylitol, sorbitol, mannitol, erythritol, dulcitol, inositol, adonitol, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, high fructose corn/starch syrup, coupling sugars, soybean oligosaccharides, or glucose syrup, and a mixture thereof.

In some embodiments, the aqueous composition of the present disclosure is substantially free of a saccharide.

In some embodiments, the water binding agent is present in an amount of from about 0.01% to about 50% by weight, from about 0.5% to about 25% by weight, from about 0.5% to about 20%, from about 2% to about 10%, from about 0.5% to about 5%, or from 5% to about 10%, based on the weight of the aqueous composition. In some embodiments, the water binding agent is present in an amount of from about 1% to about 50%, from about 1% to about 40%, from about 1% to about 30%, from about 1% to about 20%, from about 1% to about 15%, from about 1% to about 10%, from about 1% to about 5%, from about 5% to about 50%, from about 5% to about 40%, from about 5% to about 30%, from about 5% to about 20%, from about 5% to about 15%, from about 5% to about 10%, from about 10% to about 50%, from about 10% to about 40%, from about 10% to about 30%, from about 10% to about 20%, or from about 10% to about 15% by weight.

Other Components

The aqueous composition of the present disclosure may contain a surfactant stabilizer. Examples of the surfactant stabilizer include, but are not limited to, polysorbate, quillaja extract, octenyl succinic anhydride (OSA) modified starch, gum acacia, modified gum acacia, and a mixture thereof.

The aqueous composition of the present disclosure may also contain other components commonly included in a detergent composition, for example, a builder and a beneficial agent including, but not limited to an anti-redeposition agent, an enzyme, a fragrance, and a dye (colorant), a dispersing agent, a defoamer, a color component, a bleaching catalyst, a bleaching agent, a bleach activator, a whitening agent, a brightening agent, an anticorrosion agent, a deodorizing agent, a color/texture rejuvenating agent, a soil releasing polymer, a preservative, and a bittering agent, or a combination thereof.

Suitable builders include organic or inorganic detergency builders. Examples of water-soluble inorganic builders that can be used, either alone or in combination with themselves or with organic alkaline sequestrant builder salts, are glycine, alkyl and alkenyl succinates, alkali metal carbonates, alkali metal bicarbonates, phosphates, polyphosphates and silicates. Specific examples of such salts are sodium tripolyphosphate, sodium carbonate, potassium carbonate, sodium bicarbonate, potassium bicarbonate, sodium pyrophosphate and potassium pyrophosphate. Examples of organic builder salts that can be used alone, or in combination with each other, or with the preceding inorganic alkaline builder salts, are alkali metal polycarboxylates, water-soluble citrates such as sodium and potassium citrate, sodium and potassium tartrate, sodium and potassium ethylenediaminetetracetate, sodium and potassium N(2-hydroxyethyl)-nitrilo triacetates, sodium and potassium N-(2-hydroxyethyl)-nitrilo diacetates, sodium and potassium oxydisuccinates, and sodium and potassium tartrate mono- and di-succinates, such as those described in U.S. Pat. No. 4,663,071.

Fragrance (perfume) refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. The fragrance can comprise an ester, an ether, an aldehyde, a ketone, an alcohol, a hydrocarbon, or a mixture thereof.

Typically, perfumes are complex mixtures of blends of various organic compounds such as alcohols, aldehydes, ethers, aromatic compounds and varying amounts of essential oils (e.g., terpenes). The essential oils themselves are volatile odoriferous compounds and also serve to dissolve the other components of the perfume.

In some embodiments, the fragrance component is in the form of free fragrance. In some embodiments, at least some of the fragrance can be encapsulated in, for example, water-insoluble shell, microcapsule, nanocapsule or any combination thereof. The microcapsules can be water-soluble or water-insoluble.

Examples of encapsulated fragrances are described in, for example, U.S. Pat. Nos. 6,024,943, 6,056,949, 6,194,375, 6,458,754 and 8,426,353, and US 2011/0224127 A1, each of which is incorporated by reference in its entirety.

The fragrance (perfume) can have, for example, a musky scent, a putrid scent, a pungent scent, a camphoraceous scent, an ethereal scent, a floral scent, a peppermint scent, or any combination thereof. The fragrance comprises methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

Suitable enzymes include those known in the art, such as amylolytic, proteolytic, cellulolytic or lipolytic type, and those listed in U.S. Pat. No. 5,958,864. One preferred protease, sold under the trade name SAVINASE® by Novo Nordisk Industries A/S, is a subtillase from *Bacillus lentus*. Other suitable enzymes include proteases, amylases, lipases and cellulases, such as ALCALASE® (bacterial protease), EVERLASE® (protein-engineered variant of SAVINASE®), ESPERASE® (bacterial protease), LIPOLASE®

(fungal lipase), LIPOLASE ULTRA (Protein-engineered variant of LIPOLASE), LIPOPRIME® (protein-engineered variant of LIPOLASE), TERMAMYL® (bacterial amylase), BAN (Bacterial Amylase Novo), CELLUZYME® (fungal enzyme), and CAREZYME® (monocomponent cellulase), sold by Novo Nordisk Industries A/S. Also suitable for use in the present disclosure are blends of two or more of these enzymes, for example a protease/lipase blend, a protease/amylase blend, a protease/amylase/lipase blend, and the like.

All dyes (colorants) suitable for use in detergent composition can be used in herein. A variety of dye colors can be used, such as blue, yellow, green, orange, purple, clear, etc. Suitable dyes include, but are not limited to chromophore types, e.g., azo, anthraquinone, triarylmethane, methine quinophthalone, azine, oxazine thiazine, which may be of any desired color, hue or shade. Suitable dyes can be obtained from any major supplier such as Clariant, Ciba Speciality Chemicals, Dystar, Avecia or Bayer. In some embodiments, the colorant is Liquitint® Blue HP (available from Milliken Chemical), which can be added in the form of a 1% aqueous dye solution, i.e., 1% active dye+99% water.

Suitable biocidal agents include an anti-microbial, a germicide, or a fungicide. For example, a biocidal agent includes triclosan (5-chloro-2-(2,4-dichloro-phenoxy) phenol)), and the like.

Suitable optical brighteners include stilbenes such as TINOPAL® AMS; distyrylbiphenyl derivatives such as TINOPAL® CBS-X, stilbene/naphthotriazole blends (e.g., TINOPAL® RA-16, available from Ciba Geigy); oxazole derivatives, or coumarin brighteners.

Suitable foam stabilizing agents include a polyalkoxylated alkanolamide, amide, amine oxide, betaine, sultaine, $C_8$-$C_{18}$ fatty alcohols, and those disclosed in U.S. Pat. No. 5,616,781. An auxiliary foam stabilizing surfactant, such as a fatty acid amide surfactant, may also be included in the aqueous composition disclosed herein. Suitable fatty acid amides include $C_8$-$C_{20}$ alkanol amides, monoethanolamides, diethanolamides, or isopropanolamides.

Suitable anti-redeposition agents are typically polycarboxylate materials. Polycarboxylate materials, which can be prepared by polymerizing or copolymerizing suitable unsaturated monomers, are admixed in their acid form. Unsaturated monomeric acids that can be polymerized to form suitable polycarboxylates include acrylic acid, maleic acid (or maleic anhydride), fumaric acid, itaconic acid, aconitic acid, mesaconic acid, citraconic acid and methylenemalonic acid. The presence in the polycarboxylates herein of monomeric segments, containing no carboxylate radicals such as vinylmethyl ether, styrene, ethylene, etc. is suitable provided that such segments do not constitute more than about 40 wt % of the polymer.

Particularly suitable polycarboxylates can be derived from acrylic acid. Such acrylic acid-based polymers which are useful herein are the water-soluble salts of polymerised acrylic acid. The average molecular weight of such polymers in the acid form ranges from about 2,000 to 10,000, from about 4,000 to 7,000, or from about 4,000 to 5,000. Water-soluble salts of such acrylic acid polymers can include, for example, the alkali metal, ammonium and substituted ammonium salts. Soluble polymers of this type are known materials (e.g., those described in U.S. Pat. No. 3,308,067). In one embodiment, the polycarboxylate is sodium polyacrylate.

Acrylic/maleic-based copolymers may also be used as a component of the anti-redeposition agent. Such materials include the water-soluble salts of copolymers of acrylic acid and maleic acid. The average molecular weight of such copolymers in the acid form ranges from about 2,000 to 100,000, from about 5,000 to 75,000, or from about 7,000 to 65,000. The ratio of acrylate to maleate segments in such copolymers will generally range from about 30:1 to about 1:1, or from about 10:1 to 2:1. Water-soluble salts of such acrylic acid/maleic acid copolymers can include, for example, the alkali metal, ammonium and substituted ammonium salts. Soluble acrylate/maleate copolymers are known materials (e.g., those described in EP 193360). Other useful polymers include maleic/acrylic/vinyl alcohol terpolymers (e.g., a terpolymer containing 45/43/10 of acrylic/maleic/vinyl alcohol as described in EP 193360).

Polyethylene glycol can act as a clay soil removal-anti-redeposition agent. Molecular weight of suitable polyethylene glycol can range from about 1,000 to about 50,000, or about 3,000 to about 10,000. Polyaspartate and polyglutamate dispersing agents may also be used herein.

Any polymeric soil release agent known to those skilled in the art can optionally be employed herein as well. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Exemplary anti-redeposition agents include an acrylic polymer selected from SOKALAN PA 30, SOKALAN PA 20, SOKALAN PA 15, and SOKALAN CP 10 (BASF GmbH, Germany) and ACUSOL 445G and ACUSOL 445N (The Dow Chemical Company, Midland, Mich.); an acrylic acid/maleic acid copolymer selected from ACUSOL 460N and ACUSOL 505N (The Dow Chemical Company) and SOKALAN CP 5, SOKALAN CP 45, and SOKALAN CP 7 (BASF GmbH, Germany); and an anionic polymer selected from ALCOSPERSE 725 and ALCOSPERSE 747 (Alco Chemical, Chattanooga, Tenn.) and ACUSOL 480N (The Dow Chemical Company, Midland, Mich.); and DEQUEST SPE 1202 (Italmatch Chemicals, Genova, Italy); and an ethoxylated polyethylene imine SOKALAN HP 20 (BASF, Germany).

Suitable soil-releasing polymers include, but are not limited to, TEXCARE SRN—a nonionic polyester of polypropylene terephthalate (Clariant); REPEL-O-TEX SRP—a polyethylene glycol polyester (Solvay); end-capped and non-end-capped sulfonated and unsulfonated PET/POET polymers of the type as disclosed in WO 2010/069957 and WO 1995/032997; polyethylene glycol/polyvinyl alcohol graft copolymers such as SOKALAN HP 22 (BASF, Germany); and anionic hydrophobic polysaccharides of the type as disclosed in U.S. Pat. No. 6,764,992. Each of the patent references is incorporated herein by reference in its entirety.

Any suitable process can be used to make the aqueous compositions of the present disclosure.

Unit Dose Composition

In one aspect, the present disclosure provides a unit dose composition comprising, a water-soluble container and an aqueous composition of the present disclosure. The unit dose may be a pouch that comprises a water-soluble or water-dispersible film which fully encloses the aqueous composition in at least one compartment. The water-soluble container (e.g., pouch) of the present disclosure may be in any desirable shape and size, e.g., square, rectangular, oval, elliptoid, superelliptical, or circular shape.

The water-soluble container of the present disclosure is made from a water-soluble or water-dispersible material which dissolves, ruptures, disperses, or disintegrates upon contact with water, releasing thereby the composition or cleaning system contained within the container. In preferred embodiments, the water soluble single-compartment container, which may be in the form of a pouch, is formed from a water soluble polymer. Non-limiting examples of suitable water soluble polymers include polyvinyl alcohol, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, and mixtures thereof.

In some embodiments, the water-soluble or water-dispersible film material can be polyvinyl alcohol (PVOH), polyvinyl acetate (PVA), film forming cellulosic polymer, polyacrylic acid, polyacrylamide, polyanhydride, polysaccharide, or a mixture thereof. In some embodiments, the water-soluble or water-dispersible film material is polyvinyl alcohol (PVOH) or polyvinyl acetate (PVA).

In one embodiment, the water soluble container is made from a lower molecular weight water-soluble polyvinyl alcohol (PVOH) film-forming resin.

Suitable PVOH resins are sold under trade name MONOSOL® (e.g., Monosol film M8630, available from MonoSol LLC, Merrillville, Ind.). The preferred grade is MONOSOL® film having a weight average molecular weight range of about 55,000 to 65,000 and a number average molecular weight range of about 27,000 to 33,000. In some embodiments, the film material will have a thickness of approximately 3 mil or 75 micrometers. Other suitable PVOH film forming resins include those sold under trade name Solublon®, available from Aicello Corporation (e.g., Solublon® PT75, Aiichi, Japan; North American subsidiary in North Vancouver, BC, Canada).

In some embodiments, the water-soluble container may further contain a cross-linking agent, e.g., a cross-linking agent selected from the group consisting of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane (styrenes, methylmetacrylates), n-diazopyruvates, phenylboronic acids, cis-platin, divinylbenzene (styrenes, double bonds), polyamides, dialdehydes, triallyl cyanurates, N-(2-ethanesulfonylethyl)pyridinium halides, tetraalkyltitanates, titanates, borates, zireonates, or mixtures thereof. In one embodiment, the cross-linking agent is boric acid or sodium borate.

In some embodiments, the water soluble container can have a protective layer between the film polymer and the composition in the container. In some embodiments, the protective layer may comprise polytetrafluoroethylene (PTFE).

In some embodiments, the water-soluble or water-dispersible film material is between about 50 to about 120 microns thick, preferably about 60 to about 100 microns. In some embodiments, the water-soluble or water-dispersible film material has a thickness of from about 50 to about 120 microns, from about 50 to about 100 microns, from about 50 to about 80 microns, from about 50 to about 60 microns, from about 60 to about 120 microns, from about 60 to about 100 microns, from about 60 to about 80 microns, or from about 60 to about 70 microns.

The unit dose may optionally comprise additional compartments, which may comprise an additional composition. The additional composition may be liquid, solid, or mixtures thereof. Alternatively, any additional solid components may be suspended in a liquid-filled compartment. Each compartment may have the same or different compositions.

The water-soluble container (e.g., pouch) of the present disclosure may be prepared in any suitable way, such as via molding, casting, extruding or blowing, and is then filled using an automated filling process. Examples of processes for producing and filling water-soluble containers, suitable for use in accordance with the present disclosure, are described in U.S. Pat. Nos. 3,218,776; 3,453,779; 4,776,455; 5,699,653; 5,722,217; 6,037,319; 6,727,215; 6,878,679; 7,259,134; 7,282,472; 7,304,025; 7,329,441; 7,439,215; 7,464,519; and 7,595,290, each of which is incorporated herein by reference in its entirety.

Use

The aqueous composition or unit dose composition of the present disclosure can be added to a wash liquor to which laundry is present, or to which laundry is added. It may be used in combination with other laundry detergent compositions such as fabric softeners or stain removers. It may also be used in an automatic washing machine operation and added directly to the drum or to the dispenser drawer.

In some embodiments, the unit dose composition of the present disclosure is substantially free of efflorescence. Efflorescence is a phenomenon when solvated salts precipitate out on or in the film.

In some embodiments, the aqueous composition of the present disclosure comprises a beneficial composition comprising a color care agent or a softening agent.

The following examples are illustrative and non-limiting, of the device, products and methods of the present invention. Suitable modifications and adaptations of the variety of conditions, formulations and other parameters normally encountered in the field and which are obvious to those skilled in the art in view of this disclosure are within the spirit and scope of the invention.

EXAMPLES

Example 1: Water Activity of Sodium Chloride Solution

By utilizing water binding agents such as salts (i.e. sodium citrate or sodium chloride), the water activity of a high water product can be reduced to 0.9 or below to create stable unit doses (e.g. pacs). For example, the following solutions were made and their water activity were measured at 25° C. using an Aqua Lab 4TEV DUO (a water activity meter) on the capacitance setting.

| Solution | Water activity |
|---|---|
| Deionized (DI) water | 1.0 |
| 10% sodium chloride in DI Water | 0.94 |
| 16% sodium chloride in DI Water | 0.9 |
| 22% sodium chloride in DI Water | 0.86 |

When creating single dose pacs with a PVOH water-soluble film, the 10% sodium chloride solution ruptured immediately due to its high water activity. However, the 16% and 22% sodium chloride solutions can be incorporated into pacs and properly sealed. Additionally, the 22% sodium chloride solution created a much more rigid, stable pac and was not as elongated (i.e. 2.5 inches long for 16% versus 2 inches long for 22%). Pacs containing the 16% and 22% sodium chloride solutions were stable at room temperature for at least 48 hours.

Example 2: Surfactant Systems with Sodium Chloride

Solutions of 16% and 22% sodium chloride solutions were created with and without surfactant (TOMADOL 25-7 nonionic and/or Alcohol Ethoxysulfate (AES)) to mimic a detergent product. Total water level of pacs with surfactants was 55 to 72%. All pacs showed stability during the pac making process, with the pacs containing the 22% NaCl solution having superior rigidity as compared to the 16% NaCl solution. Visually, it showed that incorporating surfactants improved the pac stability by enhancing rigidity.

| | Type of NaCl Solution: | | | | | | | |
|---|---|---|---|---|---|---|---|---|
| | 16% | 22% | 16% | 16% | 22% | 22% | 16% | 22% |
| | Total Surfactants | | | | | | | |
| | 0% | 0% | 15% | 20% | 15% | 20% | 30% | 30% |
| Water (% wt) | 84 | 78 | 71.4 | 67.2 | 66.3 | 62.4 | 58.8 | 54.6 |
| Sodium Chloride (% wt) | 16 | 22 | 13.6 | 12.8 | 18.7 | 17.6 | 11.2 | 15.4 |
| TOMADOL 25-7 (% wt) | 0 | 0 | 15 | 10 | 0 | 10 | 15 | 15 |
| AES (% wt) | 0 | 0 | 0 | 10 | 15 | 10 | 15 | 15 |
| Total (% wt) | 100 | 100 | 100 | 100 | 100 | 100 | 100 | 100 |

Example 3: Lamellar Surfactant Systems with Added Salt

Initial work focused on surfactant systems to study the role that total surfactant and total added salt (for example, sodium chloride, sodium sulfate, trisodium citrate) played in pac compatibility.

TABLE 1

Fomulation of a lamellar surfactant system.

| | Activity % | Active % | Weight % |
|---|---|---|---|
| DI Water | 100 | 27 | 27 |
| Citric Acid (50%) | 50 | 3.45 | 6.9 |
| NaOH (50%) | 50 | 2.7 | 5.4 |
| Sodium Chloride | 100 | 3.16 | 3.16 |
| TEA (85%) | 85 | 2.64 | 3.1 |
| LAS | 96 | 6.03 | 6.29 |
| Cocofatty Acid | 100 | 1.72 | 1.72 |
| Alcohol Ethoxylate | 60 | 13.79 | 22.99 |
| TOMODOL 25-7 | 100 | 23.45 | 23.45 |
| | | Total | 100 |
| Total Surfactant | 45 | | |
| Total Water | 39.94 | | |

The lamellar surfactant system prepared according to Table 1 was placed into a pac. The formula contained and 45% total surfactant and almost 40% total water. The total surfactant is composed of LAS, cocofatty acid, alcohol ethoxylate, and TOMODOL 25-7. The total water amount includes added DI water and water present in other materials, such as 50% citric acid and 50% NaOH. Despite the high water amount, the pac survived the pac making process. There was no evidence of elongation.

It is unexpectedly discovered that the formulation (i.e., the components and ratios thereof) of the above composition, even with only a very small amount of a salt, allows the composition to reach a critical interchangeable biphase (gel-liquid transition) stage by slightly adjusting the concentration of the active. For example, the composition of Table 1 might be presented in a gel form. Upon dilution to around 40% active, the gel form was transitioned to a liquid form. Further, when the active was adjusted back slightly, even to about 40.25%, the composition re-formed to the gel phase. At this point, additional pacs were prepared from the re-formed gel phase, which contained a water level of approximately 45% (verses the earlier prepared pacs having a water level of 40%).

Because of the structured nature of the gel, it can serve to suspend particles, specifically encapsulated fragrances. For example, 0.50% encapsulated fragrance slurry and 0.50% fragrance oil were added in the composition in Table 1, and placed into a pac. The pac was stable, and the encapsulates showed no signs of settling or creaming out.

Water activity was measured, ranging from 0.868 to 0.899, which is higher than that of commercial unit dose formulations, which range from 0.30 to 0.65.

Example 4: Unit Dose Detergent Compositions

Lamellar laundry detergent formulations were prepared by incorporating polymers, enzymes, chelators, fragrances, and other functional materials commonly used in a finished product into a base similar to that in Table 1. The formula is shown in Table 2.

TABLE 2

| | Activity % | Active % | Weight % |
|---|---|---|---|
| DI Water | 100 | 17.75 | 17.75 |
| Citric Acid (50%) | 50 | 3.45 | 6.9 |
| NaOH (50%) | 50 | 2.7 | 5.4 |
| Sodium Chloride | 100 | 4 | 4 |
| TEA (85%) | 85 | 2.64 | 3.1 |
| LAS | 96 | 6.03 | 6.29 |
| Cocofatty Acid | 100 | 1.72 | 1.72 |
| Tinopal CBS-X | 100 | 0.3 | 0.3 |
| Alcohol Ethoxysulfate | 60 | 13.79 | 22.99 |
| Polyethylene Imine, ethoxylated | 80 | 2 | 2.5 |
| Acusol 445N | 45 | 0.6 | 1.33 |
| Bitrex | 25 | 0.013 | 0.05 |
| IDS | 34 | 0 | 0 |
| Protease Enzyme | 100 | 2.5 | 2.5 |
| Mannanase Enzyme | 100 | 0.6 | 0.6 |
| Amylase Enzyme | 100 | 0.35 | 0.35 |
| Liquitint Blue HP | 100 | 0.026 | 0.026 |
| Fragrance | 100 | 0.75 | 0.75 |
| Tomodol 25-7 | 100 | 23.45 | 23.45 |
| | | Total | 100 |
| Total Surfactant | 45 | | |
| Total Water | 33.7 | | |

Pacs were made with the formula from Table 2. They survived the pac-making process, and were stable, indicating that lamellar systems can incorporate common performance-enhancing laundry materials.

Utilizing the above formula in Table 2 as a base, different salts were screened for modifying rheology. Sodium chloride, trisodium citrate, sodium sulfate, and magnesium sulfate were all added at 5% by weight to the above formula. Pacs were made, and were left in the open air to force any film instabilities, and to observe pac firmness over time. Trisodium citrate provided the best results.

Example 5: Physical Properties of Detergent Compositions

Two formulations were prepared according to Tables 3A and 3B. The rheology of the low active gels and the high active gels were very different. As shown in FIG. 1, the low active/high salt formulation (HS Formulation, Table 3A) has a larger distance between its elastic and viscous moduli (G', G" respectively), indicating a more solid-like material. On the other hand, the high active/low salt formulation (LS Formulation, Table 3B) has a smaller distance between its viscous and elastic moduli, indicating a more gel-like material. Formulas are provided in Tables 3A and 3B. As shown by polarized optical microscopy, the patterns of the lamellar structures of HS and LS formulations are different. All of these discoveries were unexpected.

TABLE 3A

| | Activity % | Active % | Weight % |
|---|---|---|---|
| DI Water | 100 | 39.34 | 39.34 |
| Citric Acid (50%) | 50 | 2.3 | 4.6 |
| NaOH (50%) | 50 | 1.8 | 3.6 |
| Trisodium Citrate | 100 | 6 | 6 |
| TEA (85%) | 85 | 1.76 | 2.07 |
| LAS | 96 | 4.02 | 4.19 |
| Cocofatty Acid | 100 | 1.15 | 1.15 |
| TINOPAL CBS-X | 100 | 0.82 | 0.82 |
| Alcohol Ethoxysulfate | 60 | 9.2 | 15.33 |
| Polyethylene Imine, ethoxylated | 80 | 0.15 | 0.19 |
| ACUSOL 445N | 45 | 0.68 | 1.52 |
| Bitrex | 25 | 0.013 | 0.05 |
| IDS | 34 | 0.82 | 2.41 |
| Protease Enzyme | 100 | 2.33 | 2.33 |
| Mannanase Enzyme | 100 | 0 | 0 |
| Amylase Enzyme | 100 | 0 | 0 |
| Liquitint Blue HP | 100 | 0.026 | 0.026 |
| Fragrance | 100 | 0.75 | 0.75 |
| TOMODOL 25-7 | 100 | 15.63 | 15.63 |
| | | Total | 100 |
| Total Surfactant | 30 | | |
| Total Water | 51.63 | | |

TABLE 3B

| | Activity % | Active % | Weight % |
|---|---|---|---|
| DI Water | 100 | 18.67 | 18.67 |
| Citric Acid (50%) | 50 | 3.45 | 6.9 |
| NaOH (50%) | 50 | 2.7 | 5.4 |
| Trisodium Citrate | 100 | 2 | 2 |

TABLE 3B-continued

| | Activity % | Active % | Weight % |
|---|---|---|---|
| TEA (85%) | 85 | 2.64 | 3.1 |
| LAS | 96 | 6.03 | 6.29 |
| Cocofatty Acid | 100 | 1.72 | 1.72 |
| TINOPAL CBS-X | 100 | 0.3 | 0.3 |
| Alcohol Ethoxysulfate | 60 | 13.79 | 22.99 |
| Polyethylene Imine, ethoxylated | 80 | 2 | 2.5 |
| Polyacrylate Polymer (modified) | 40 | 0.6 | 1.5 |
| Bitrex | 25 | 0.013 | 0.05 |
| IDS | 34 | 0.31 | 0.91 |
| Protease Enzyme | 100 | 2.5 | 2.5 |
| Mannanase Enzyme | 100 | 0.6 | 0.6 |
| Amylase Enzyme | 100 | 0.35 | 0.35 |
| Liquitint Blue HP | 100 | 0.026 | 0.026 |
| Fragrance | 100 | 0.75 | 0.75 |
| TOMODOL 25-7 | 100 | 23.45 | 23.45 |
| | | Total | 100 |
| Total Surfactant | 45 | | |
| Total Water | 35.33 | | |

Figure 2:
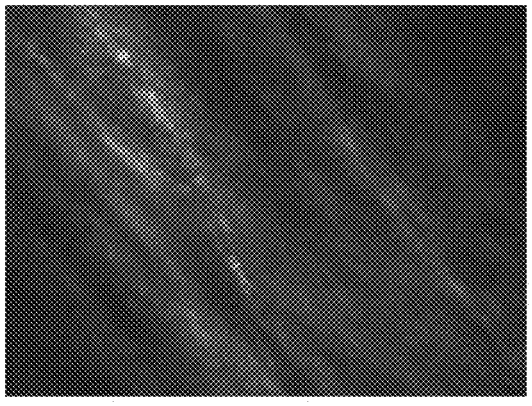
FIG. 2 shows an image of lamella structure of a surfactant system in accordance with one embodiment of the invention, exhibiting "Mosaic" pattern, which was taken from a polarized optical microscope.
Figure 3:
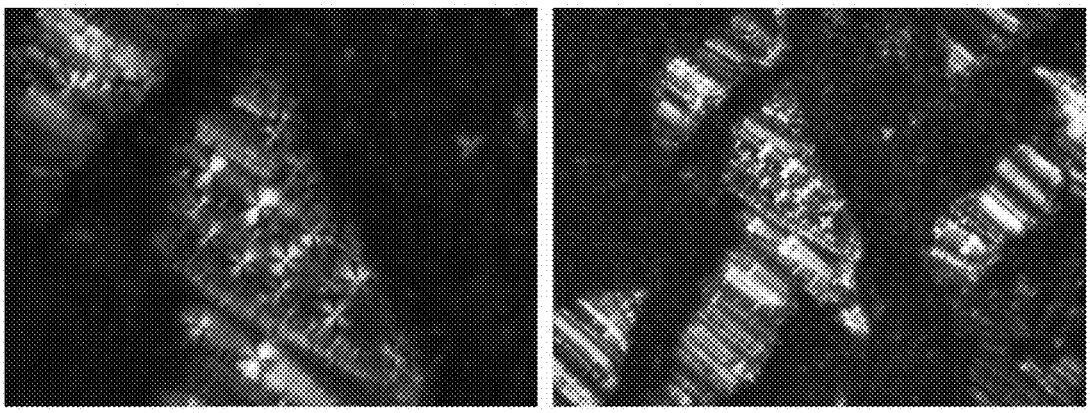
FIG. 3 shows images of lamella structure of a surfactant system in accordance with another embodiment of the invention, exhibiting "Maltese Crosses" pattern, which were taken from a polarized optical microscope.
Figure 4:
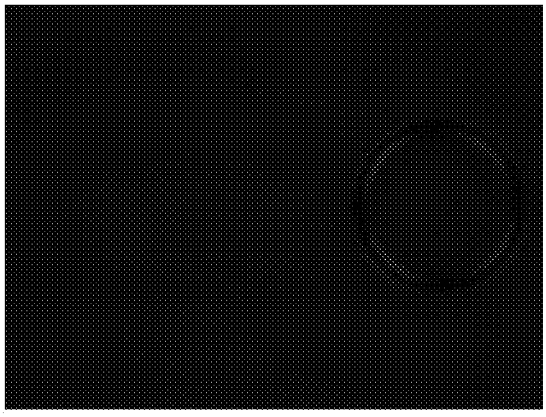
FIG. 4 provides an image of a negative control (isotropic system), which shows no lamellar structure.

Polarized optical microscopy can be used to confirm lamella structure of surfactant formulations. The polarized optical microscopy of the formulation of Table 3A exhibited "Mosaic", indicating lamellar structure, as shown in the image of FIG. 2. And "Maltese Crosses" pattern, as shown in the images of FIG. 3, was identified in the polarized optical microscopy of the formulation of Table 3B, also indicating lamellar structure. The images of FIGS. 2 and 3 were taken from a polarized optical microscope that exhibit the optical patterns produced by lamellar systems. The images were obtained by adding a small amount of sample to a slide mount, then using a polarized filter to observe the sample. The microscope used was an Olympus BH-2 optical microscope fitted with a polarizer at the light source. FIG. 2 shows an image which was magnified by 100 times. The image on the left side of FIG. 3 was magnified by 200 times and the images on the right side of FIG. 3 was magnified by 100 times under the microscope. FIG. 4, a negative control (isotropic system), is provided, which shows no lamellar structure.

Example 6: Formulations Containing Organic Solvent(s)

As shown in Tables 4A-4C, multiple formulations (indicated by F1 to F14) containing glycerin and propylene glycol were prepared and they exhibited compatibility when placed in polyvinyl alcohol film pacs, with water activity ranging from 0.50 to 0.73. The pH of these formulations was about 7.7, ranging from 7.2 to 8.3. Solvents other than glycerin or propylene glycol that can be used in a similar manner include PEG 300, PEG 400, 2-methyl 1,3-propanediol, 1,3-propanediol, butylene glycol, and pentanediol.

TABLE 4A

| | % activity | Water Content | F1 | F2 | F3 | F4 | F5 |
|---|---|---|---|---|---|---|---|
| Zeolite Water | 100 | 100 | 15.776 | 18.058 | 13.847 | 13.789 | 9.68 |
| C12-C15 Alcohol Ethoxylate 7EO | 99.85 | 0.2 | 23.074 | 23.074 | 23.074 | 23.074 | 23.074 |
| Propylene Glycol | 99.9 | 0.12 | 10 | 3.334 | 17.511 | 7.825 | 12.402 |
| Optical Brightener | 100 | 0 | 0.3 | 0.3 | 0.3 | 0.3 | 0.3 |
| Glycerin | 99.85 | 0.25 | 14.75 | 19.133 | 9.168 | 18.912 | 18.444 |

TABLE 4A-continued

| | % activity | Water Content | F1 | F2 | F3 | F4 | F5 |
|---|---|---|---|---|---|---|---|
| Bitrex | 25 | 0 | 0.05 | 0.05 | 0.05 | 0.05 | 0.05 |
| Alcohol Ethoxylate Sulfate | 60 | 24.5 | 26 | 26 | 26 | 26 | 26 |
| 50% NaOH Solution | 50 | 49 | 1.1 | 1.1 | 1.1 | 1.1 | 1.1 |
| Coconut Fatty Acids | 100 | 0 | 4 | 4 | 4 | 4 | 4 |
| Polyethylene Imine, ethoxylated | 44 | 50 | 1.5 | 1.5 | 1.5 | 1.5 | 1.5 |
| Iminodisuccinate (sodium salt) | 33 | 66 | 0.9 | 0.9 | 0.9 | 0.9 | 0.9 |
| Mannanase Enzyme Solution | 8 | 50 | 0.6 | 0.6 | 0.6 | 0.6 | 0.6 |
| Amylase Enzyme Solution | 8 | 50 | 0.35 | 0.35 | 0.35 | 0.35 | 0.35 |
| Protease Enzyme Solution | 8 | 50 | 1.6 | 1.6 | 1.6 | 1.6 | 1.6 |
| Total (no DI Water) | | | 84.244 | 81.942 | 86.153 | 86.211 | 90.32 |
| Total | | | 100 | 100 | 100 | 100 | 100 |
| Water Activity | | | 0.702 | 0.712 | 0.679 | 0.671 | 0.608 |
| Total Water Content | | | 25.4 | 27.68 | 23.47 | 23.42 | 19.32 |

TABLE 4B

| | % activity | Water Content | F6 | F7 | F8 | F9 | F10 |
|---|---|---|---|---|---|---|---|
| Zeolite Water | 100 | 100 | 8.309 | 18.416 | 18.255 | 17.852 | 12.15 |
| C12-C15 Alcohol Ethoxylate 7EO | 99.85 | 0.2 | 23.074 | 23.074 | 23.074 | 23.074 | 23.074 |
| Propylene Glycol | 99.9 | 0.12 | 17.814 | 6.125 | 18.162 | 10.99 | 14.403 |
| Optical Brightener | 100 | 0 | 0.3 | 0.3 | 0.3 | 0.3 | 0.3 |
| Glycerin | 99.85 | 0.25 | 14.403 | 15.985 | 4.109 | 11.683 | 13.974 |
| Bitrex | 25 | 0 | 0.05 | 0.05 | 0.05 | 0.05 | 0.05 |
| Alcohol Ethoxylate Sulfate | 60 | 24.5 | 26 | 26 | 26 | 26 | 26 |
| 50% NaOH Solution | 50 | 49 | 1.1 | 1.1 | 1.1 | 1.1 | 1.1 |
| Coconut Fatty Acids | 100 | 0 | 4 | 4 | 4 | 4 | 4 |
| Polyethylene Imine, ethoxylated | 44 | 50 | 1.5 | 1.5 | 1.5 | 1.5 | 1.5 |
| Iminodisuccinate (sodium salt) | 33 | 66 | 0.9 | 0.9 | 0.9 | 0.9 | 0.9 |
| Mannanase Enzyme Solution | 8 | 50 | 0.6 | 0.6 | 0.6 | 0.6 | 0.6 |
| Amylase Enzyme Solution | 8 | 50 | 0.35 | 0.35 | 0.35 | 0.35 | 0.35 |
| Protease Enzyme Solution | 8 | 50 | 1.6 | 1.6 | 1.6 | 1.6 | 1.6 |
| Total (no DI Water) | | | 91.691 | 81.584 | 81.745 | 82.148 | 87.85 |
| Total | | | 100 | 100 | 100 | 100 | 100 |
| Water Activity | | | 0.589 | 0.719 | 0.719 | 0.729 | 0.654 |
| Total Water Content | | | 17.94 | 28.04 | 27.86 | 27.47 | 21.78 |

TABLE 4C

| | % Activity | Water Content | F11 | F12 | F13 |
|---|---|---|---|---|---|
| Zeolite Water | 100 | 100 | 17.936 | 4.39 | 14.309 |
| C12-C15 Alcohol Ethoxylate 7EO | 99.85 | 0.2 | 23.074 | 23.074 | 23.074 |
| Propylene Glycol | 99.9 | 0.12 | 14.471 | 17.45 | 10.319 |
| Optical Brightener | 100 | 0 | 0.3 | 0.3 | 0.3 |
| Glycerin | 99.85 | 0.25 | 8.119 | 18.686 | 15.898 |
| Bitrex | 25 | 0 | 0.05 | 0.05 | 0.05 |

TABLE 4C-continued

| | % Activity | Water Content | F11 | F12 | F13 |
|---|---|---|---|---|---|
| Alcohol Ethoxylate Sulfate | 60 | 24.5 | 26 | 26 | 26 |
| 50% NaOH Solution | 50 | 49 | 1.1 | 1.1 | 1.1 |
| Coconut Fatty Acids | 100 | 0 | 4 | 4 | 4 |
| Polyethylene Imine, ethoxylated | 44 | 50 | 1.5 | 1.5 | 1.5 |
| Iminodisuccinate (sodium salt) | 33 | 66 | 0.9 | 0.9 | 0.9 |

TABLE 4C-continued

| | % Activity | Water Content | F11 | F12 | F13 |
|---|---|---|---|---|---|
| Mannanase Enzyme Solution | 8 | 50 | 0.6 | 0.6 | 0.6 |
| Amylase Enzyme Solution | 8 | 50 | 0.35 | 0.35 | 0.35 |
| Protease Enzyme Solution | 8 | 50 | 1.6 | 1.6 | 1.6 |
| Total (no DI Water) | | | 82.064 | 95.610 | 85.691 |
| Total | | | 100 | 100 | 100 |
| Water Activity | | | 0.625 | 0.492 | 0.702 |
| Total Water Content | | | 27.55 | 14.03 | 23.94 |

Example 7: Physical Properties of Formulations Containing Organic Solvent(s)

A base mixture was prepared according to the formulation in Table 5A. Additional solvents were added in to the base mixture to bring the solvent systems (containing water, propylene glycol, glycerine, and/or PEG 400) of comparative compositions and inventive compositions, as shown in Table 5B. The pH of these formulations was about 7.7, ranging from 7.2 to 8.3. Unit dose pacs were prepared using the comparative compositions and the inventive compositions, which were subjected to testing on their dissolution rate, pac height, and % weight loss after aging under the same conditions (i.e., 4 weeks at 105° F. and at 50% relative humidity). The test results are reported in Table 5C.

TABLE 5A

| Description | % wt |
|---|---|
| C12-C15 Alcohol Ethoxylate 7EO | 23.074 |
| Water | 4.000 |
| AES (60% Active) | 22.360 |
| Other Ingredients | 3.925 |
| Coconut Fatty Acids | 4.000 |
| Enzymes (about 8% active) | 1.600 |
| Total | 58.959 |

TABLE 5B

| | Water (% wt) (added) | PG (% wt) | GLY (% wt) | PEG 400 (% wt) | Total Water (% wt) |
|---|---|---|---|---|---|
| Comparative 1 | 12.21 | 16.42 | 16.42 | 0 | 23.80 |
| Comparative 2 | 12.21 | 0 | 32.83 | 0 | 23.80 |
| Comparative 3 | 12.21 | 32.83 | 0 | 0 | 23.80 |
| Inventive 1 | 12.21 | 10.94 | 10.94 | 10.94 | 23.80 |
| Inventive 2 | 12.21 | 0 | 0 | 32.83 | 23.80 |
| Inventive 3 | 12.21 | 0 | 16.42 | 16.42 | 23.80 |
| Inventive 4 | 12.21 | 16.42 | 0 | 16.42 | 23.80 |
| Comparative 4 | 20.42 | 24.62 | 0 | 0 | 32.01 |
| Comparative 5 | 20.42 | 12.31 | 12.31 | 0 | 32.01 |
| Comparative 6 | 20.42 | 0 | 24.62 | 0 | 32.01 |
| Inventive 5 | 20.42 | 0 | 12.31 | 12.31 | 32.01 |
| Inventive 6 | 20.42 | 0 | 0 | 24.62 | 32.01 |
| Inventive 7 | 20.42 | 8.21 | 8.21 | 8.21 | 32.01 |
| Inventive 8 | 20.42 | 12.31 | 0 | 12.31 | 32.01 |

TABLE 5C

| | Water activity | 4 wk 105° F. Dissolution (second) | 2 wk RT Pac Height (inch) | 4 wk 105° F. Pac Height (inch) | % Weight Loss |
|---|---|---|---|---|---|
| Comparative 1 | 0.628 | 644.5 | 0.699 | 0.680 | 5.92 |
| Comparative 2 | 0.620 | 582 | 0.698 | 0.622 | 4.49 |
| Comparative 3 | 0.641 | 718.5 | 0.791 | 0.770 | 3.88 |
| Inventive 1 | 0.653 | 436.5 | 0.803 | 0.809 | 4.06 |
| Inventive 2 | 0.713 | 439 | 0.823 | 0.815 | 6.48 |
| Inventive 3 | 0.657 | 433 | 0.822 | 0.813 | 2.95 |
| Inventive 4 | 0.685 | 480 | 0.821 | 0.813 | 6.45 |
| Comparative 4 | 0.751 | 1380 | 0.656 | 0.678 | 5.98 |
| Comparative 5 | 0.737 | 994.5 | 0.615 | 0.600 | 7.37 |
| Comparative 6 | 0.736 | 971.5 | 0.604 | 0.564 | 9.10 |
| Inventive 5 | 0.758 | 791 | 0.817 | 0.798 | 4.21 |
| Inventive 6 | 0.790 | 473 | 0.821 | 0.781 | 2.67 |
| Inventive 7 | 0.757 | 717.5 | 0.711 | 0.738 | 7.74 |
| Inventive 8 | 0.776 | 859 | 0.818 | 0.796 | 5.50 |

Example 8: Formulations Containing Corn Syrup

Table 6A shows formulations (F14, F15, and F16) using Light Corn Syrup to control the water activity. All of these liquids showed stability during pac making with PVOH film and while aging across 38° F. to 125° F.

The formulas in the example had about 14% active surfactant, and similar formulas can be prepared with light corn syrup containing 50% active surfactant.

TABLE 6A

| Description | % Water | F14 % in Formula | F15 % in Formula | F16 % in Formula |
|---|---|---|---|---|
| Glycerine | 0.25 | 0 | 0 | 5 |
| C12-C15 Alcohol Ethyoxylate 7EO | 0.2 | 9 | 9 | 9 |
| Propylene Glycol | 0.12 | 5 | 10 | 10 |
| Zeolite Water | 100 | 11.15 | 9.6 | 9.6 |
| Coconut Oil Fatty Acid | — | 2 | 4 | 4 |
| Sodium C12-C14 Alcohol Ethoxysulfate 3EO (60% active) | 24.5 | 9 | 9 | 9 |
| Bitrix | — | 0.05 | 0.05 | 0.05 |
| Light Corn Syrup | 20 | 63 | 57 | 52 |
| 50% Sodium Hydroxide Solution | 49 | 0.6 | 1.15 | 1.15 |
| Tinopal CBS-X Swiss | — | 0.2 | 0.2 | 0.2 |
| Total | | 100 | 100 | 100 |
| % Total Water | | 26.273 | 23.799 | 22.811 |
| Water activity at 25° C. | | 0.81 | 0.71 | 0.75 |

Table 6B shows formulations (F17 to F21) using High Fructose Corn Syrup (HFCS) 42 and to High Fructose Corn Syrup 55 to control the water activity. All of these liquids showed stability during pac making with PVOH film and while aging across 38 OF to 125° F. Similar formulas can be prepared with other types of HFCS.

TABLE 6B

| Description | F17 % in Formula | F18 % in Formula | F19 % in Formula | F20 % in Formula | F21 % in Formula |
|---|---|---|---|---|---|
| C12-C15 Alcohol Ethyoxylate 7EO | 5 | 23.27 | 23.27 | 23.27 | 23.27 |
| Propylene Glycol | 6 | 5.75 | 5.75 | 5.75 | 5.75 |

TABLE 6B-continued

| Description | F17 % in Formula | F18 % in Formula | F19 % in Formula | F20 % in Formula | F21 % in Formula |
|---|---|---|---|---|---|
| Zeolite Water (added) | 8 | 8 | 8 | 8 | 8 |
| Coconut Oil Fatty Acid | 2 | 4 | 4 | 4 | 4 |
| Sodium C12-C14 Alcohol Ethoxysulfate 3EO (60% active) | 5 | 26 | 26 | 26 | 26 |
| Enzymes | 0 | 1.5 | 1.5 | 2.45 | 2.45 |
| Fragrance | 0.55 | 0.55 | 0.55 | 0.55 | 0.55 |
| Other Ingredients | 0.95 | 4.43 | 4.43 | 7.43 | 7.43 |
| HFCS 42 | 0 | 26.5 | 0 | 21.5 | 0 |
| HFCS 55 | 72.5 | 0 | 26.5 | 0 | 21.5 |
| Total | 100 | 100 | 100 | 100 | 100 |
| % Total Water | 26 | 27 | 27 | 28 | 28 |
| Water activity at 25° C. | 0.76 | 0.764 | 0.743 | 0.765 | 0.762 |
| Pac Height after 3 days, 75° F. (inches) (max. 0.82 inches) | 0.68 | 0.75 | 0.79 | 0.72 | 0.77 |

Corn Syrup is substantially less expensive than non-aqueous solvents such as propylene glycol. Not wishing to be bound by the theory, it is believe that corn syrup allows for bound water to be incorporated into the final product, which will have a reduced effect on film plasticization or solvation.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

All publications, patent applications, patents, and other references mentioned herein are incorporated by reference in their entirety. In case of conflict, the present specification, including definitions, will control. In addition, section headings, the materials, methods, and examples are illustrative only and not intended to be limiting.

What is claimed is:

1. A unit dose product comprising:

(a) a water-soluble container formed from a water-soluble or water-dispersible film material;

(b) an aqueous composition comprising:

(i) water present in an amount of about 25% to about 70% by weight;

(ii) a surfactant system present in an amount of about 0.1% to about 70% by weight; and (iii) high fructose corn syrup water binding agent present in an amount of about 0.5% to about 50% by weight;

wherein the aqueous composition is enclosed in the water-soluble container and has a water activity of from 0.65 to 0.95.

2. The unit dose product of claim 1, wherein the water binding agent is present in an amount of from about 4% to about 40% by weight.

3. The unit dose product of claim 1, wherein the water binding agent is present in an amount of from about 20% to about 30% by weight.

4. The unit dose product of claim 1, wherein the aqueous composition comprises from about 25% to about 55% by weight of water.

5. The unit dose product of claim 1, wherein the aqueous composition is substantially free of a salt.

6. The unit dose product of claim 1, wherein the aqueous composition is substantially free of a hygroscopic chelant.

7. The unit dose product of claim 1, wherein the aqueous composition is substantially free of a polymer that stabilizes the water-soluble container.

8. The unit dose product of claim 1, wherein the aqueous composition further comprises a salt in an amount of about 0.5% to about 25% by weight.

9. The unit dose product of claim 1, wherein the surfactant system comprises:

(1) an anionic surfactant, and (2) a non-ionic surfactant.

10. The unit dose product of claim 9, wherein the surfactant system further comprises a zwitterionic surfactant or an amphoteric surfactant.

11. The unit dose product of claim 9, wherein the anionic surfactant is linear alkylbenzene sulfonic acid or a salt thereof, alkyl ethoxylated sulphate, alkyl propoxy sulphate, alkyl sulphate, or a mixture thereof.

12. The unit dose product of claim 9, wherein the nonionic surfactant is alcohol ethoxylate, alcohol propoxylate, or a mixture thereof.

13. The unit dose product of claim 1, wherein the surfactant system comprises:

(1) a linear alkylbenzene sulfonate (LAS) and/or an alcohol ethoxylsulfate (AES), (2) an alcohol ethoxylate (AE), and (3) a fatty acid.

14. The unit dose product of claim 13, wherein the LAS is present in an amount of about 10% to about 20% by weight;

the AES is present in an amount of about 20% to about 40% by weight;

the AE is present in an amount of about 20% to about 50% by weight; and the fatty acid is present in an amount of about 1% to about 15% by weight.

15. The unit dose product of claim 13, wherein the weight ratio of LAS:AES:AE is about 1:2:3.

16. The unit dose composition of claim 1, wherein the aqueous composition further comprises a fragrance composition comprising a neat oil, an encapsulated fragrance, an oil-in-water emulsion, or a combination thereof; wherein the fragrance composition is present in an amount from about 0.1% to about 15% by weight.

17. A unit dose product comprising:

(a) a water-soluble container formed from a water-soluble or water-dispersible film material;

(b) an aqueous composition comprising:

(i) water present in an amount of about 25% to about 40% by weight;

(ii) a surfactant system present in an amount of about 8% to about 60% by weight;

(iii) a fatty acid present in an amount of about 2% to about 4% by weight; and (iv) high fructose corn syrup water binding agent present in an amount of about 0.5% to about 50% by weight;

wherein the aqueous composition is enclosed in the water-soluble container.

18. The unit dose product of claim 17, wherein the aqueous composition has a water activity of from 0.65 to 0.95; and wherein the aqueous composition is substantially free of a salt.

* * * * *